US009574857B1

(12) United States Patent
Kravel

(10) Patent No.: US 9,574,857 B1
(45) Date of Patent: Feb. 21, 2017

(54) TRIP FLARE WITH FLASH BANG

(71) Applicant: Combined Systems, Inc., Jamestown, PA (US)

(72) Inventor: Jacob Kravel, Great Neck, NY (US)

(73) Assignee: COMBINED SYSTEMS, INC., Jamestown, PA (US)

( * ) Notice: Subject to any disclaimer, the term of this patent is extended or adjusted under 35 U.S.C. 154(b) by 0 days.

(21) Appl. No.: 14/979,659

(22) Filed: Dec. 28, 2015

(51) Int. Cl.
*F42B 4/16* (2006.01)
*F42B 4/26* (2006.01)
*F42C 7/02* (2006.01)

(52) U.S. Cl.
CPC . *F42B 4/26* (2013.01); *F42B 4/16* (2013.01); *F42C 7/02* (2013.01)

(58) Field of Classification Search
CPC ..... F42B 4/16; F42B 4/26; F42B 12/36; F42B 12/42; F42B 12/44; F42B 12/46; F42B 12/48; F42B 12/50; F42B 12/52; F42C 7/02
USPC ..... 102/336, 338, 345
See application file for complete search history.

(56) References Cited

U.S. PATENT DOCUMENTS 624,530 A * 5/1899 Pain ..... F42B 4/00 102/337
1,771,455 A * 7/1930 Wiley ..... F42B 10/56 102/364
2,044,024 A * 6/1936 Wiley ..... F42B 4/28 102/338
2,961,962 A * 11/1960 Jackson ..... F42B 8/28 102/336
4,013,009 A * 3/1977 Claude ..... F42B 10/56 102/339
4,651,648 A * 3/1987 Alon ..... F42B 10/56 102/334
5,313,888 A * 5/1994 Martin ..... C06B 21/0041 102/205
5,631,441 A * 5/1997 Briere ..... F42B 5/15 102/326
5,654,523 A * 8/1997 Brunn ..... F42B 8/26 102/368

(Continued)

OTHER PUBLICATIONS

Headquarters, Department of the Army, FM 3-23.30 "Grenades and Pyrotechnic Signals," Published Oct. 2009, pp. 1-2, 4-11 to 4-15, B-8 to B-10.

*Primary Examiner* — Bret Hayes
(74) *Attorney, Agent, or Firm* — Bennet K. Langlotz; Langlotz Patent & Trademark Works, Inc.

(57) ABSTRACT

A trip flare with flash bang has a body having a sidewall and a hollow interior, a lid releasably attached to the body, the lid including a fuse, the interior of the body containing an illuminant composition in communication with the fuse, and a flash bang charge composition in communication with the fuse and attached to the lid by an elongated flexible tether. The tether may be a coil when received within the interior of the body. There may be an ignition composition proximate the illuminant composition such that combustion of the ignition composition ignites the illuminant composition. The flash bang charge composition may have a pyrotechnic fuse proximate the ignition composition such that combustion of the ignition composition ignites the pyrotechnic fuse. There may be a first fire composition proximate the ignition composition such that combustion of the first fire composition ignites the ignition composition.

17 Claims, 4 Drawing Sheets

(56) References Cited

U.S. PATENT DOCUMENTS

| | | | | |
|---|---|---|---|---|
| 2006/0230972 | A1* | 10/2006 | Ouliarin | F42B 8/18<br>102/487 |
| 2010/0212533 | A1* | 8/2010 | Brunn | F42B 4/26<br>102/502 |
| 2012/0247359 | A1* | 10/2012 | Brunn | F42B 27/00<br>102/334 |

* cited by examiner

TRIP FLARE WITH FLASH BANG

FIELD OF THE INVENTION

The present invention relates to grenades, and more particularly to a trip flare with flash bang for police and military forces to secure an area and guard against infiltration.

BACKGROUND OF THE INVENTION

The M49 trip flare resembles a hand grenade in size and shape, except that it is provided with a bracket for attachment to a tree or post and a trigger mechanism for firing. Surface trip flares can be used to provide early warning of infiltration of enemy troops or signaling, illuminate an immediate area, ignite fires, identify firing ports, force the enemy to withdraw, and destroy small, sensitive pieces of equipment in the same manner as an incendiary grenade.

The M49 trip flare is issued with a spool of tripwire and nails. When the tripwire is triggered by someone disturbing it, the flare is activated. The pull on the tripwire causes either the trigger tongue or pull pin to release the lever, which in turn permits the firing pin to strike the primer. The primer sets off the intermediate charge, and the intermediate charge ignites the first fire composition on the ignition increment of the flare.

The light from the flare simultaneously warns the perimeter of the secured area may have been breached and also provides light for investigating. The flare provides a light intensity of about 35,000 candlepower for a minimum of 30 seconds. The area of illumination in which the flare can be seen is approximately 300 m radius. However, although the M49 trip flare functions as intended, illumination alone may not be sufficient to deter an aggressor from attempting to occupy the secured area.

Therefore, a need exists for a new and improved trip flare with flash bang that discharges a flash bang component after the illumination component is ignited. In this regard, the various embodiments of the present invention substantially fulfill at least some of these needs. In this respect, the trip flare with flash bang according to the present invention substantially departs from the conventional concepts and designs of the prior art, and in doing so provides an apparatus primarily developed for the purpose of providing a trip flare with flash bang that discharges a flash bang component after the illumination component is ignited.

SUMMARY OF THE INVENTION

The present invention provides an improved trip flare with flash bang, and overcomes the above-mentioned disadvantages and drawbacks of the prior art. As such, the general purpose of the present invention, which will be described subsequently in greater detail, is to provide an improved trip flare with flash bang that has all the advantages of the prior art mentioned above.

To attain this, the preferred embodiment of the present invention essentially comprises a body having a sidewall and a hollow interior, a lid releasably attached to the body, the lid including a fuse, the interior of the body containing an illuminant composition in communication with the fuse, and a flash bang charge composition in communication with the fuse and attached to the lid by an elongated flexible tether. The tether may be a coil when received within the interior of the body. There may be an ignition composition proximate the illuminant composition such that combustion of the ignition composition ignites the illuminant composition. The flash bang charge composition may have a pyrotechnic fuse proximate the ignition composition such that combustion of the ignition composition ignites the pyrotechnic fuse. There may be a first fire composition proximate the ignition composition such that combustion of the first fire composition ignites the ignition composition. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
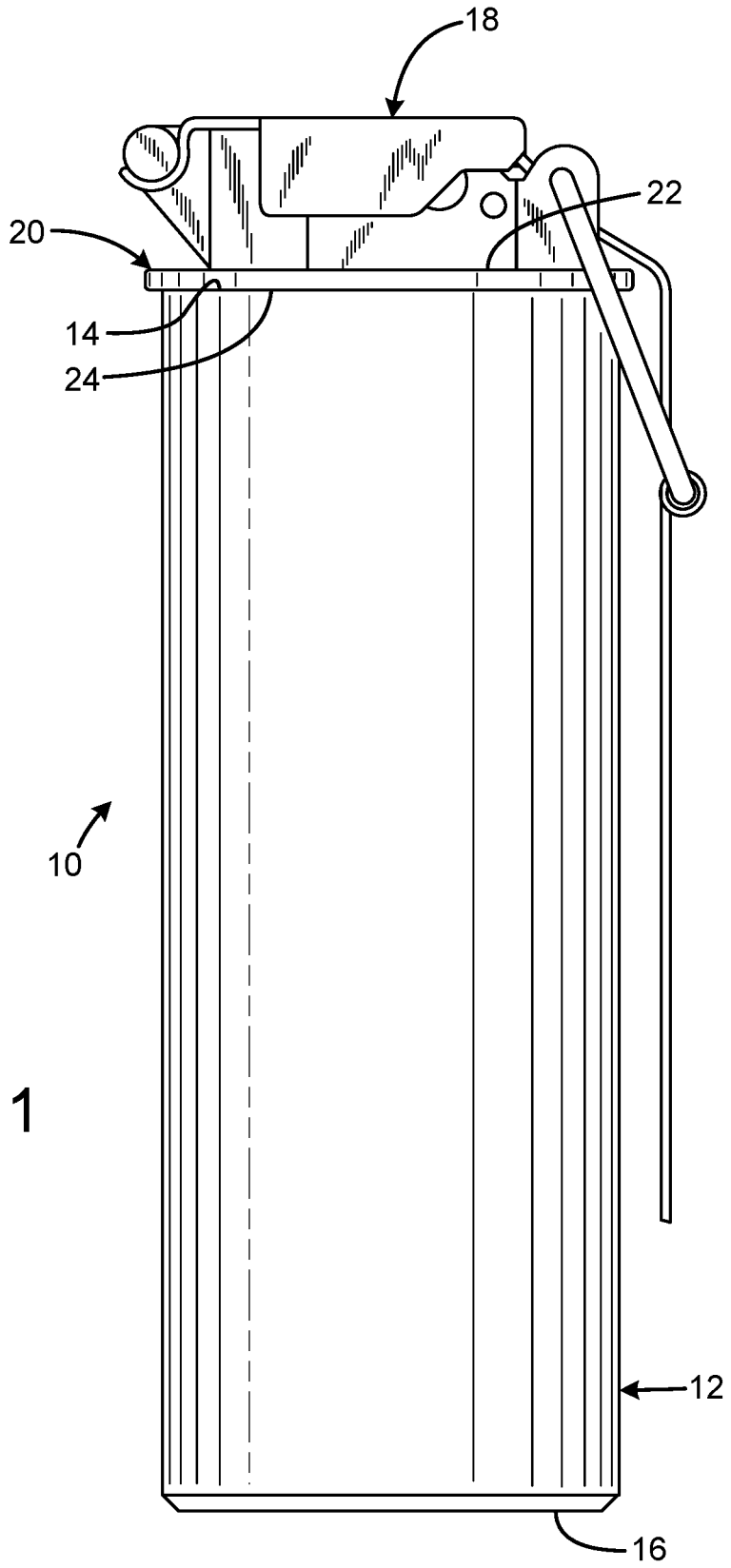
FIG. 1 is a left side view of the current embodiment of a trip flare with flash bang constructed in accordance with the principles of the present invention.

An embodiment of the trip flare with flash bang of the present invention is shown and generally designated by the reference numeral 10.

Figure 2:
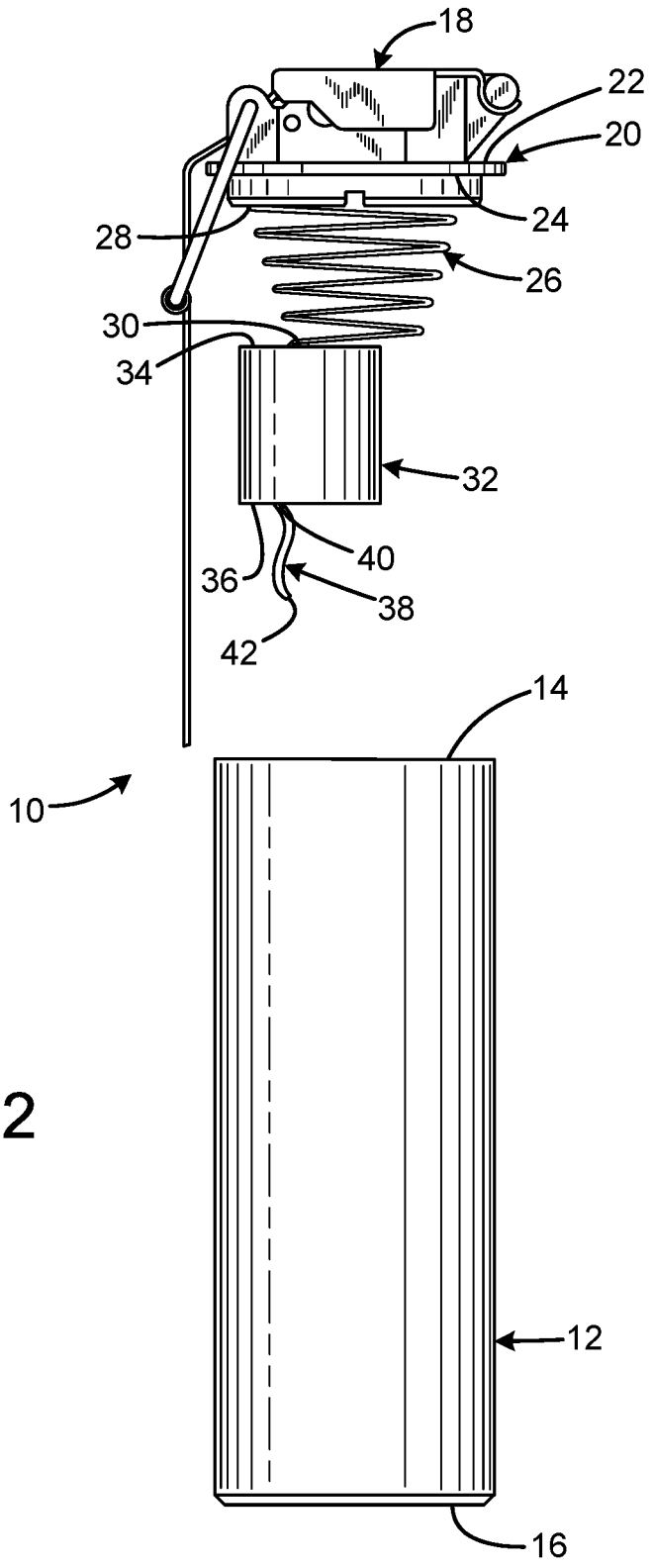
FIG. 2 is an exploded view of the trip flare with flash bang of FIG. 1.
Figure 3:
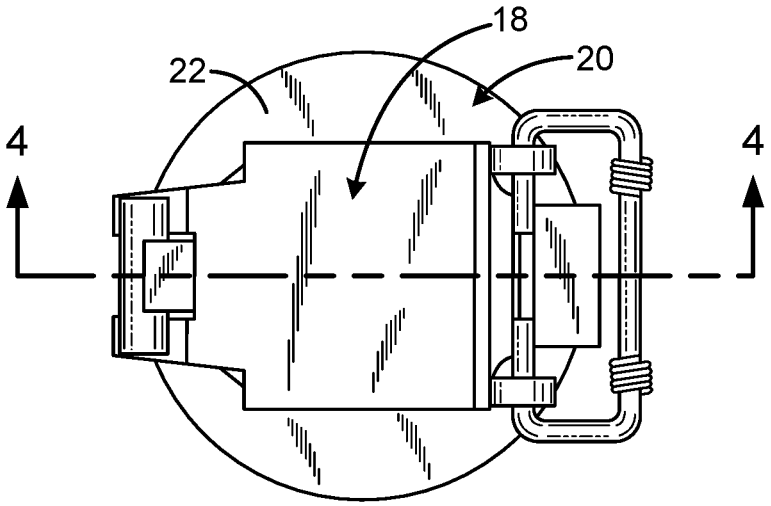
FIG. 3 is a top view of the trip flare with flash bang of FIG. 1.
Figure 4:
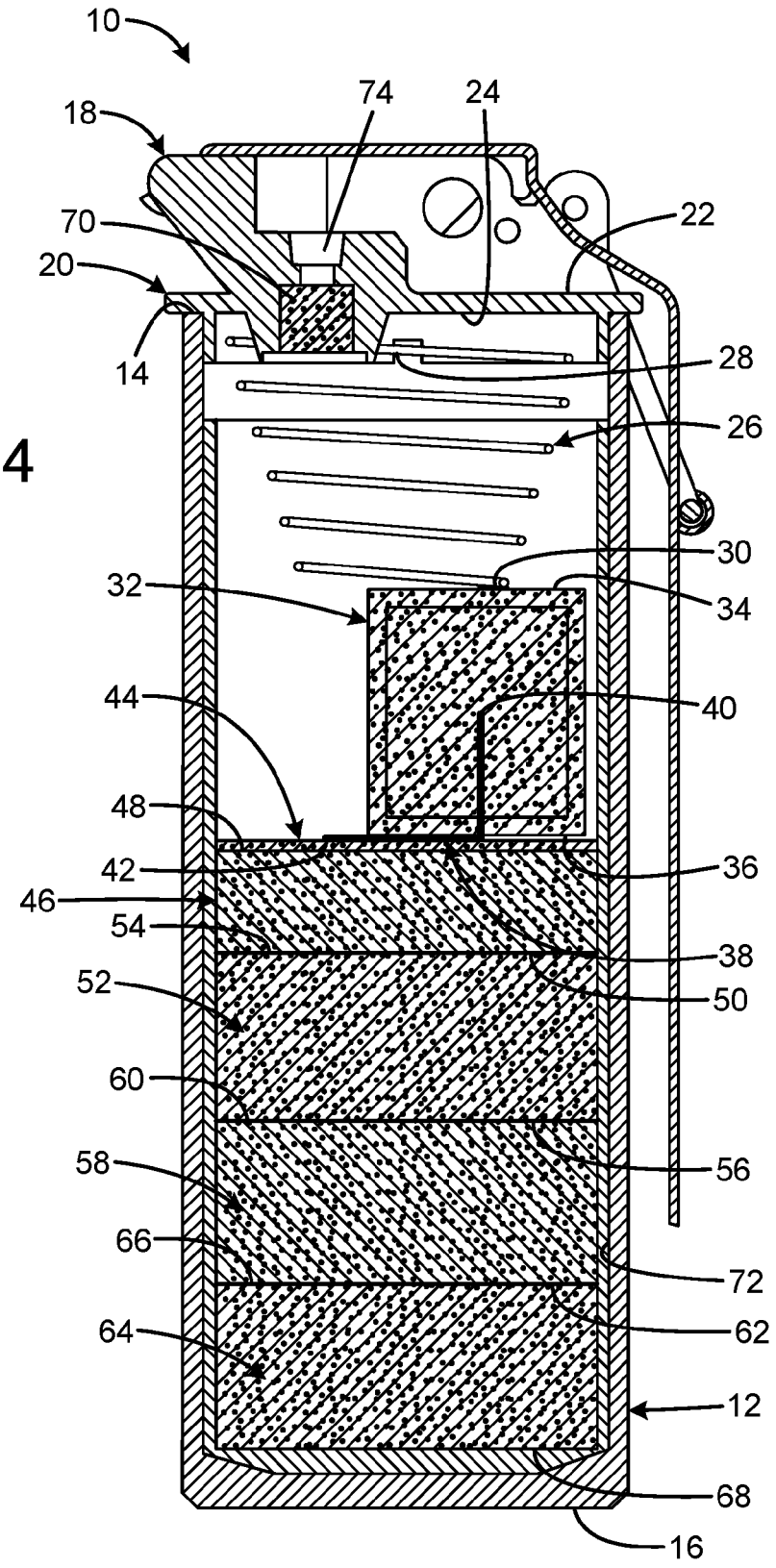
FIG. 4 is a left side sectional view of the trip flare with flash bang of FIG. 1.

FIGS. 1-4 illustrate the improved trip flare with flash bang 10 of the present invention in a filled state. More particularly, the trip flare with flash bang has a cylindrical body 12 having a top 14, a bottom 16, and an interior 72. The bottom of the body is closed, and the top of the body is open.

A fuse 18 mounted on a lid 20 is releasably attached to the top 14 of the body 12. The lid has a top 22 and a bottom 24. Fuse includes an intermediate charge 70. The fuse, lid, and body are identical to those of a standard M49A1 surface trip flare as described in FM 3-23.30 "Grenades and Pyrotechnic Signals" published by Headquarters, Department of the Army (October 2009), and in TM 43-0001-37 "Technical Manual Army Ammunition Data Sheets: Military Pyrotechnics (Federal Supply Class 1370)" published by Headquarters, Department of the Army (January 1994), which are hereby incorporated by reference for all that they teach therein. The trip flare with flash bang 10 has a pressed fit lid. As a result, only a minimal internal pressure is required to detach the lid from the body. This is intentional to avoid the possibility of an explosion. The lid also ejects at a slow speed so it does not fragment or have the ability to cause injury.

Unlike the conventional M49A1 trip flare, the trip flare with flash bang 10 has a flexible coiled wire 26 with one end 28 secured to the bottom 24 of the lid 20 and an opposed end 30 secured to the top 34 of a flash bang charge 32. In the current embodiment, epoxy is used to secure the ends of the coiled wire to the lid and flash bang charge. The coiled wire is not a spring and provides no force, but is just loosely coiled for compactness to fit within the interior 72 of the body 12. The coiled wire can be made of any material capable of maintaining structural integrity when exposed to the heat generated by the burning illuminant composition 42, including 1006, 1008, or 1010 steel or similar material with a diameter of about 0.0204".

A pyrotechnic fuse 38 has one end 40 going inside the bottom 36 of the flash bang charge 32 and an opposing free end 42. The pyrotechnic fuse imparts a delay of about 1 second after the pyrotechnic fuse is lit before the flash charge ignites. The flash bang charge is loose within the interior of the body, and is only attached to the wire 26 and the pyrotechnic fuse.

When the trip flare with flash bang 10 is in a filled state, the free end 42 of the pyrotechnic fuse 38 rests in a comparatively thin layer of first fire composition 44 within the interior 72 of the body 12 adjacent to a layer of ignition composition 46. The first fire composition rests on the top 48 of the layer of ignition composition. The bottom 50 of the ignition composition rests on the top 54 of a first layer of illuminant composition 52. The bottom 56 of the first layer of illuminant composition rests on the top 60 of a second layer of illuminant composition 58. The bottom 62 of the second layer of illuminant composition rests on the top 66 of a third layer of illuminant composition 64. The bottom 68 of the third layer of illuminant composition contacts at least a portion of the bottom 16 of the body.

When the trip flare with flash bang 10 is activated by a pull on an attached tripwire (not shown), the firing pin of the fuse 18 strikes the primer 74. The primer sets off the intermediate charge 70, and the intermediate charge ignites the first fire composition 44. The first fire composition ignites the ignition composition 46, which ignites the pyrotechnic fuse 38. Pressure resulting from the burning first fire composition and ignition composition is released by launching the lid 20, wire 26, flash bang charge 32, and pyrotechnic fuse 38 upwards into the air well above the top 14 of the body 12. The lid and flash bang charge reliably tend to rise together, so that the coiled wire 26 serves as a tether, but the wire does not create tension between the lid and the flash bang charge or necessarily extend to its full length. As a result, the flash bang charge is significantly separated from the body for safety at the time of discharge so that shrapnel is not created.

While the pyrotechnic fuse continues to burn, the ignition composition ignites the layers of illuminant composition 52, 58, 64 in turn, and the light emitted by the burning layers of illuminant composition is emitted through the now open top of the body. Once the burning portion of the pyrotechnic fuse reaches the flash bang charge, the flash bang charge discharges. The additional light and considerable percussive noise resulting from the discharge of the flash bang charge of the trip flare with flash bang 10 is much more likely to deter an aggressor from attempting to occupy the secured area than just a conventional M49A1 trip flare.

In the current embodiment, the intermediate charge 70 consists of 90% by weight barium chromate and 10% by weight boron for a total weight of 0.1 g. The flash bang charge 32 consists of 2.64 g aluminum/magnesium mix and 3.36 g potassium perchlorate for a total weight of 6 g. The first fire composition before consists of 88.7% by weight barium chromate, 9.8% by weight boron and by weight for a total weight of 6 g. The ignition composition 46 consists of 48% by weight magnesium, 52% by weight sodium nitrate, and 10% by weight binder for a total weight of 30 g. The layers of illuminant composition 52, 58, 64 consist of 38% by weight magnesium, 52% by weight sodium nitrate, and 10% binder for a total weight of up to 70 g each.

While a current embodiment of a trip flare with flash bang has been described in detail, it should be apparent that modifications and variations thereto are possible, all of which fall within the true spirit and scope of the invention. For example, the illuminant composition described could be replaced by an obscurant composition to produce a smoke grenade with flash bang or by an irritant composition to create a teargas grenade with flash bang. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trip flare comprising:

a body having a sidewall and a hollow interior;

a lid releasably attached to the body;

the lid including a fuse;

the interior of the body containing an illuminant composition in communication with the fuse; and a flash bang charge composition in communication with the fuse and attached to the lid by an elongated flexible tether.

2. The trip flare of claim 1 wherein the tether is a coil when received within the interior of the body.

3. The trip flare of claim 1 further comprising an ignition composition proximate the illuminant composition such that combustion of the ignition composition ignites the illuminant composition.

4. The trip flare of claim 3 wherein the flash bang charge composition has a pyrotechnic fuse proximate the ignition composition such that combustion of the ignition composition ignites the pyrotechnic fuse.

5. The trip flare of claim 3 further comprising a first fire composition proximate the ignition composition such that combustion of the first fire composition ignites the ignition composition.

6. The grenade of claim 5 further comprising an intermediate charge within the fuse, the intermediate charge proximate the first fire composition such that combustion of the intermediate charge ignites the first fire composition.

7. The trip flare of claim 3 wherein gases resulting from combustion of the ignition composition launch the lid and flash bang charge above the body.

8. The trip flare of claim 7 wherein the lid rises above the flash bang charge such that the flash bang charge hangs close to the lid on the elongated tether.

9. A trip flare comprising:

a body having a sidewall and a hollow interior;

a lid releasably attached to the body;

the lid including a fuse;

the interior of the body containing combustible composition in communication with the fuse; and a flash bang charge composition in communication with the fuse and attached to the lid by an elongated flexible tether.

10. The trip flare of claim 9 wherein the combustible composition is selected from the group consisting of an illuminant composition, and obscurant composition, and an irritant composition.

11. The trip flare of claim 9 wherein the tether is a coil when received within the interior of the body.

12. The trip flare of claim 9 further comprising an ignition composition proximate the combustible composition such that combustion of the ignition composition ignites the combustible composition.

13. The trip flare of claim 12 wherein the flash bang charge composition has a pyrotechnic fuse proximate the ignition composition such that combustion of the ignition composition ignites the pyrotechnic fuse.

14. The trip flare of claim 12 further comprising a first fire composition proximate the ignition composition such that combustion of the first fire composition ignites the ignition composition.

15. The grenade of claim 14 further comprising an intermediate charge within the fuse, the intermediate charge proximate the first fire composition such that combustion of the intermediate charge ignites the first fire composition.

16. The trip flare of claim 12 wherein gases resulting from combustion of the ignition composition launch the lid and flash bang charge above the body.

17. The trip flare of claim 16 wherein the lid rises close to the flash bang charge such that the flash bang charge hangs close to the lid on the elongated tether.

* * * * *